US006218950B1

(12) United States Patent
Politze et al.

(10) Patent No.: US 6,218,950 B1
(45) Date of Patent: Apr. 17, 2001

(54) SCATTERED LIGHT FIRE DETECTOR

(75) Inventors: Heiner Politze, Neuss; Martin Bemba, Köln; Tido Krippendorf, Erkelenz, all of (DE)

(73) Assignee: Caradon Esser GmbH, Neuss (DE)

( * ) Notice: Subject to any disclaimer, the term of this patent is extended or adjusted under 35 U.S.C. 154(b) by 0 days.

(21) Appl. No.: 09/487,164

(22) Filed: Jan. 19, 2000

(30) Foreign Application Priority Data

Jan. 21, 1999 (DE) ..... 199 02 319

(51) Int. Cl.[7] ..... G08B 17/10
(52) U.S. Cl. ..... 340/630; 340/628; 340/619
(58) Field of Search ..... 340/630, 619, 340/628, 627

(56) References Cited

U.S. PATENT DOCUMENTS 5,430,307 * 7/1995 Nagashima ..... 250/574
5,502,434 * 3/1996 Minowa et al. ..... 340/630
5,576,697 * 11/1996 Nagashima et al. ..... 340/630
6,011,478 * 1/2000 Suzuki et al. ..... 340/630

FOREIGN PATENT DOCUMENTS 42 31 088 A1 3/1993 (DE) .

* cited by examiner

*Primary Examiner*—Nina Tong
*Assistant Examiner*—Son Tang
(74) *Attorney, Agent, or Firm*—Henry M. Feiereisen

(57) ABSTRACT

A scattered light fire detector and a method for evaluating scattering signals of a fire detector are disclosed. The microprocessor-based scattered light fire detector measures the scattering signals at two scattering angles and determines an alarm threshold. An alarm value is determined as a function of the ratio of the scattering signals and compared with the determined alarm threshold. The fire detector can be used with mixed fires without prior calibration. Fraudulent measurement values arising, for example, from water vapor can be stored in a memory.

35 Claims, 4 Drawing Sheets

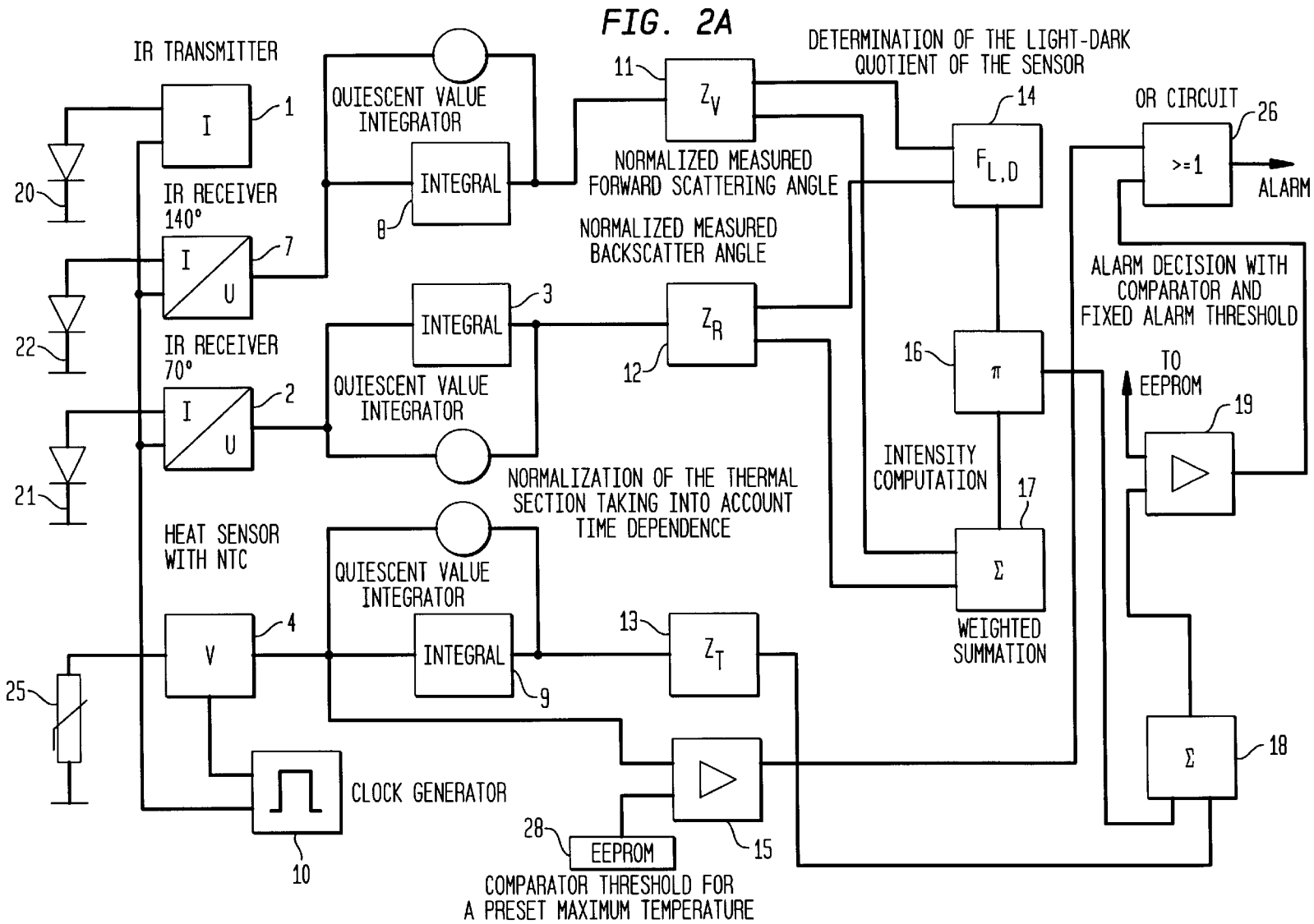
FIG. 2A
IR TRANSMITTER
I
1
20
IR RECEIVER 140°
I
U
7
22
IR RECEIVER 70°
I
U
2
21
HEAT SENSOR WITH NTC
V
4
25
QUIESCENT VALUE INTEGRATOR
INTEGRAL
8
QUIESCENT VALUE INTEGRATOR
INTEGRAL
3
QUIESCENT VALUE INTEGRATOR
INTEGRAL
9
CLOCK GENERATOR
10
NORMALIZED MEASURED FORWARD SCATTERING ANGLE
$Z_V$
11
NORMALIZED MEASURED BACKSCATTER ANGLE
$Z_R$
12
NORMALIZATION OF THE THERMAL SECTION TAKING INTO ACCOUNT TIME DEPENDENCE
$Z_T$
13
DETERMINATION OF THE LIGHT-DARK QUOTIENT OF THE SENSOR
$F_{L,D}$
14
INTENSITY COMPUTATION
π
16
WEIGHTED SUMMATION
Σ
17
Σ
18
ALARM DECISION WITH COMPARATOR AND FIXED ALARM THRESHOLD
TO EEPROM
19
OR CIRCUIT
>=1
26
ALARM
EEPROM
28
COMPARATOR THRESHOLD FOR A PRESET MAXIMUM TEMPERATURE
15

SCATTERED LIGHT FIRE DETECTOR

CROSS-REFERENCES TO RELATED APPLICATIONS

This application claims the priority of German Patent Application, Serial No. 199 02 319.0, filed Jan. 21, 1999, the subject matter of which is incorporated herein by reference.

BACKGROUND OF THE INVENTION

The invention is directed to a method for evaluating scattering signals measured with a scattered light system of a fire detector which may include a microprocessor. The scattering signals are measured at two scattering angles to determine an alarm value which is compared with an alarm threshold. The invention is also directed to a fire detector for carrying out the method.

Scattered light fire detectors typically operate with infrared light emitted by a transmitter diode at a wavelength between 800 nm and 1 $\mu$m. The fire produces an aerosol which enters a measurement volume of the fire detector. The light scattered by the aerosol is measured at a backscatter angle, i.e., at an angle between 0° and 90°, and/or a forward scattering angle, i.e., a scattering angle between 90° and 180°. These angles are in relation to an axis connecting the transmitter with the receiver.

The measurement of light aerosols at a forward scattering angle produces a relatively large measurement signal. Conversely, the measurement of dark aerosols at a forward scattering region produces a measurement signal which is smaller by approximately a factor 10. The magnitude of the measurement signals increases with increasing forward scattering angle. The signal produced in the backscattering regime is independent of the type of smoke and smaller than in the forward scattering regime. The difference between the scattering signals of light and dark aerosols in the backscattering regime is noticeably smaller than in the forward scattering regime.

Conventional scattered light fire detectors operating in the forward scattering regime recognize different types of dark smoke less reliably than different types of light smoke. Accordingly, the sensitivity of the fire detectors has to be adjusted to the dark smoke to safely trigger an alarm. Such a sensitivity setting, however, tends to cause a high incidence of false alarms, since the detector is too sensitive to the light smoke. In particular, a false alarm can be triggered by water vapor, cigarette smoke, vapors or fumes produced by hot grease. Conventional scattered light fire detectors are therefore not suitable for use, for example, in large kitchens or in saw mills, since the intensive vapors and dust produced in these places can be easily mistaken for light smoke.

Fire detectors operating in the backscattering regime, however, are adversely affected by particles and dust or by salt crystals which can enter the measurement volume of the fire detector and produce a significant backscatter signal, thereby producing a significant risk of false alarms.

German Pat. No. DE 42 31 088 A1 discloses a method wherein scattering signals of an aerosol which may be present in the measurement volume of a scattered light fire detector, are measured under at least two scattering angles and compared with reference data for various types of smoke which are stored in a memory. The method determines the type of smoke present in the measurement volume and sets an alarm value depending on the type of smoke. However, this method is suitable mainly for analyzing known types of smoke using the reference data stored in the memory, and may produce erroneous results for the more frequently occurring mixed fires, since such mixed fires cannot be adequately classified.

SUMMARY OF THE INVENTION

It is therefore desirable to provide a method which reliably recognizes the most common types of smoke and which can in particular evaluate mixed fires, without setting off a disproportionate number of false alarms.

According to one aspect of the invention, a method is provided which determines the alarm value as a function of the ratio of the scattering signals.

This approach takes into account that most common fires are mixed fires which produce aerosols which cannot always be unambiguously classified. The ratio of the scattering signals, also referred to as the light-dark-quotient, produces a continuous rating of the aerosols which may be present in the measurement volume of the fire detector, thereby obviating the need to store predetermined smoke patterns for comparison with the measurement result. For example, if a small light-dark-quotient is the determined, then it can be concluded that a light aerosol is present. Likewise, a large light-dark-quotient is indicative of dark aerosols. Accordingly, the alarm value is determined as a function of the brightness of the aerosol. The type of smoke which is actually present need not be determined. As a result, the sensitivity of a scattered light detector operating according to the method of the invention can be maintained at an approximately constant value for all aerosols, i.e., independent of the brightness of an aerosol, thereby significantly reducing the risk of a false alarm. The two optical paths for the scattered light should be arranged in such a way that one of the paths responds predominantly to light aerosols, whereas the other path responds predominantly to dark aerosols.

According to one embodiment of the invention, the backscatter angle is approximately 70°. The signals produced by scattering IR radiation from an aerosol have a minimal value at approximately this scattering angle. The measurement values can be calibrated in this way and the light-dark-quotient reliably determined. The forward scattering angle may be approximately twice the backscatter angle.

Advantageously, the ratio of the scattering signals for at least one "fraudulent" value, which are determined at these measurement angles, may be stored in a memory. A "fraudulent" value is referred to as a value of a scattering ratio which is known to produce a false alarm. These fraudulent values may originate from, for example, water vapor, dust and/or vapors from manufacturing processes. In this way, fraudulent values can be recognized as such and positively distinguished from smoke, so that a false alarm is not triggered. Accordingly, a scattered light fire detector operating according to the method of the invention can also be used in environments where conventional fire detectors cannot be employed due to their high susceptibility to false alarms. The susceptibility of the detector to false alarms can thus be adapted to the actual requirements.

The light-dark-quotient quotient $S_R/S_V$ ($S_R$: backscattering signal, $S_V$: forward scattering signal) is typically in the range between 0.2 and 0.8 and can be further processed by determining a factor F, F' defined as $$F=((S_R/S_V)-0.2)/0.6$$

for $(S_R/S_V)$ between 0.2 and 0.8, and $$F'=2-((S_R/S_V)-0.2)/0.2$$

for ($S_R/S_V$) greater than 0.8.

The factors F, F' can then be used to determine the brightness of the aerosol.

A light-dark-quotient of the 0.2, i.e., F=0, indicates the presence of a very light smoke, wherein a light-dark-quotient of 0.8, i.e., F=1, indicates the presence of a very dark smoke. Water vapor produces a ratio $S_R/S_V$ of approximately 0.20, which is not produced by any other known type of aerosol, making it possible to identify water vapor uniquely as a fraudulent value. If fraudulent values, such as dust and the like, are present in the measurement volume of the fire detector, then the quotient $S_R/S_V$ can be greater than 1. In this case, the backscattering signal is greater than the forward scattering signal, so that the factor F' should be determined. Such large values suggest that most probably no combustion aerosols are present in the measurement volume of the fire detector and only fraudulent values are indicated. This can be taken into consideration when the measurement signal is evaluated.

The alarm value may be a weighted sum of the values corresponding to the scattering signals. This summation takes into consideration the different weight of the measurement values determined at the two scattering angles. Alternatively, instead of the sum of the scattering signals, only the weighted forward scattering signal or only the weighted backscattering signal may be considered for determining the alarm value.

Additional relevant parameters, such as the ambient temperature, may be considered for determining the alarm value by multiplying the scattering signals with at least one value corresponding to an additional input value, such as the ambient temperature. Alternatively, the temperature may be considered independent of the measured scattering signals. With such arrangement, even a fire that produces almost no aerosols at all, such as an alcohol fire, can trigger an alarm.

To compensate for stray light, a quiescent value is determined for each scattering angle, and the quiescent value is subtracted from the corresponding scattering signal.

The scattering signals may be determined simultaneously or alternatingly, depending if a measurement system with one transmitter diode and two receiver diodes or a measurement system with two transmitter diodes and one receiver diode is employed.

Fraudulent values may advantageously be suppressed by filtering the scattering signals before the scattering signals are processed.

According to another aspect of the invent ion, a scattered light fire detector includes a scattered light system for determining scattering signals having at least a forward scattering angle and a backscatter angle, where in an alarm value is determined as a function of the ratio of the scattering signals at the different scattering angles.

Embodiments of the fire detector may include one or more of the following features. The scattered light fire detector may have one transmitter diode and two receiver diodes, or two transmitter diodes and one receiver diode. The detector may also include an EEPROM for storing parameters, for example, the light-dark quotient of water vapor, and may advantageously be provided with an interface for connection to a computer, so that the parameters can be adapted to the respective operational conditions using suitable software. The fire detector may also include an NTC sensor, such as a thermistor, or a thermocouple for measuring the ambient temperature.

BRIEF DESCRIPTION OF THE DRAWING

The above and other objects, features and advantages of the present invention will be more readily apparent upon reading the following description of a preferred exemplified embodiment of the invention with reference to the accompanying drawing, in which:

FIG. 2*a* shows a schematic circuit diagram for carrying out the method according to the invention;

DETAILED DESCRIPTION OF CERTAIN EMBODIMENTS

Figure 1A:
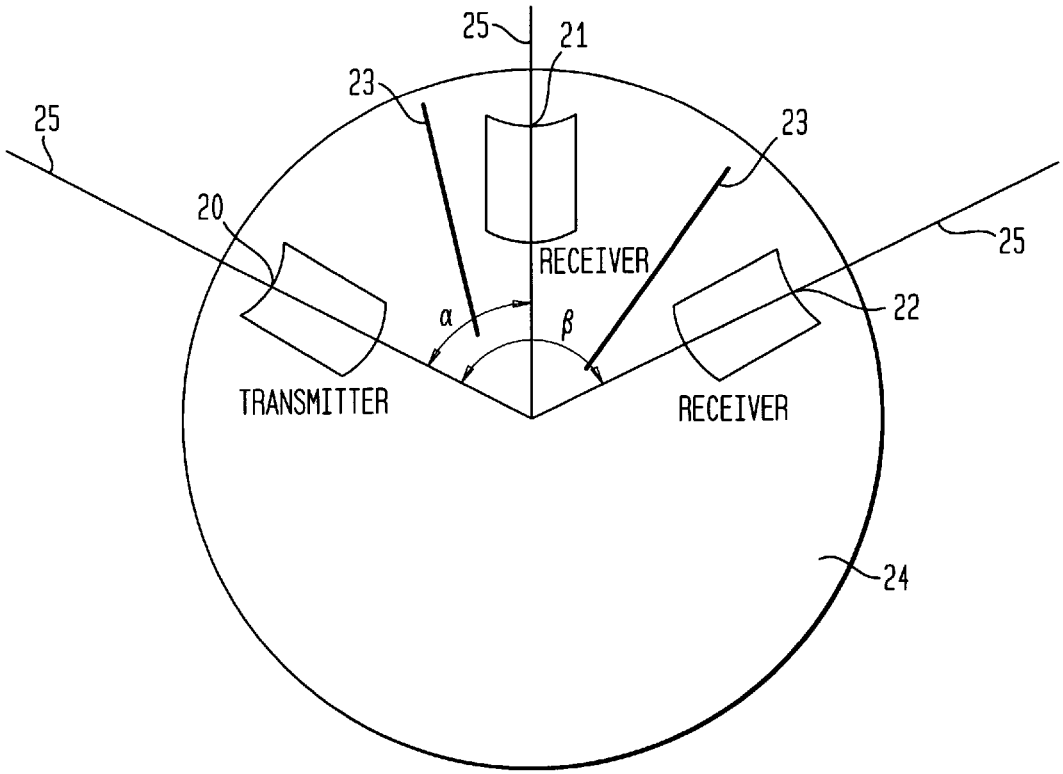
FIGS. 1*a* and 1*b* show two different measurement setups of a scattered light system.
Figure 1B:
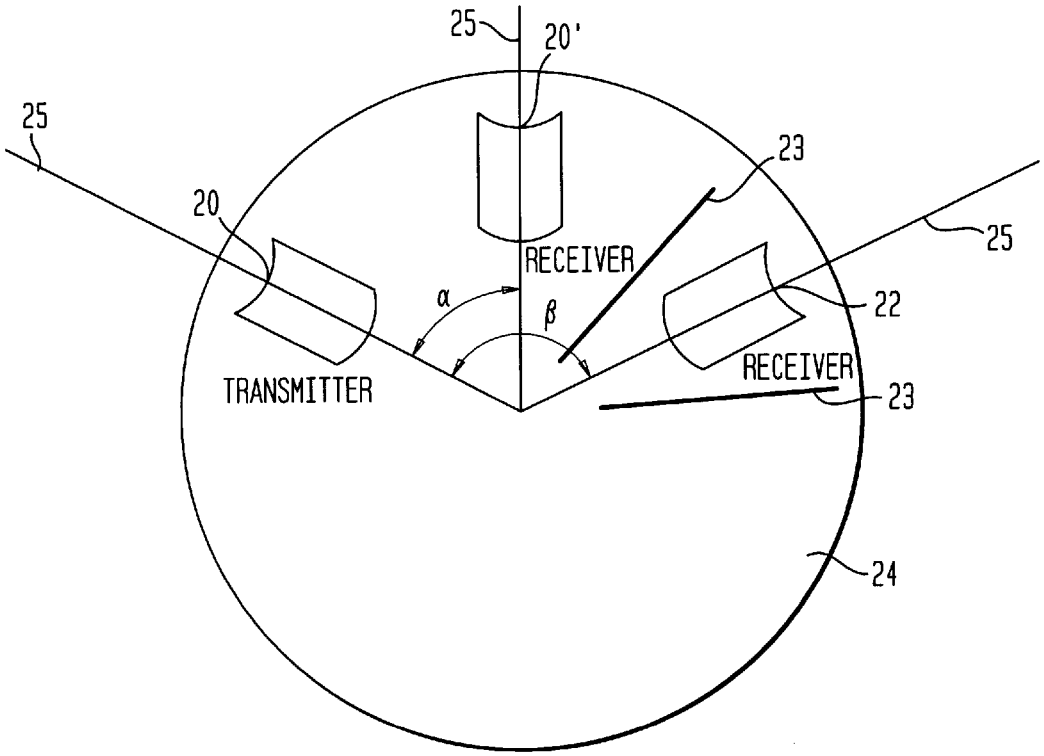

FIGS. 1*a* and 1*b* shows schematically a measurement chamber 24 of a scattered light fire detector. In one embodiment illustrated in FIG. 1*a*, the measurement chamber 24 includes a transmitter 20 for transmitting IR radiation and two receivers 21, 22. The receivers 21, 22 may include lenses made of a material which absorbs light in the visible range of the spectrum and transmits infrared light. The transmitter 20 and the receivers 21, 22 have optical axes 25 which include an angle $\alpha$ of smaller than 90° and an angle $\beta$ greater than 90°, respectively. Accordingly, the measurement setup includes a backscatter path and a forward scattering path. Optical baffles 23 may be provided to prevent radiation emitted by the transmitter 20 from striking the receivers 21 and 22 directly.

In an alternate embodiment illustrated in FIG. 1*b*, the measurement chamber may include two transmitters and one receiver. In this case, the receiver 21 would be replaced by a transmitter 20', so that the receiver 22 receives the radiation scattered an angle $\alpha$ smaller than 90° from the transmitter 20' and the radiation scattered an angle $\beta$ greater than 90° from the transmitter 20. The baffles 23 would then be placed next to the receiver 22, as also indicated in FIG. 1*b*. The transmitters 20 and 20' would be operated at different times, for example, alternatingly, and the received signals would be separated electronically to determine the forward scattered and backscattered signal components. Only the embodiment of FIG. 1*a* will be described further.

The electrical circuit components of the fire detector shown in FIG. 2*a* may be implemented in form of a microprocessor. The microprocessor may be coupled to an EEPROM 28 and a working memory (not shown) in a manner known in the art.

Figure 2B:
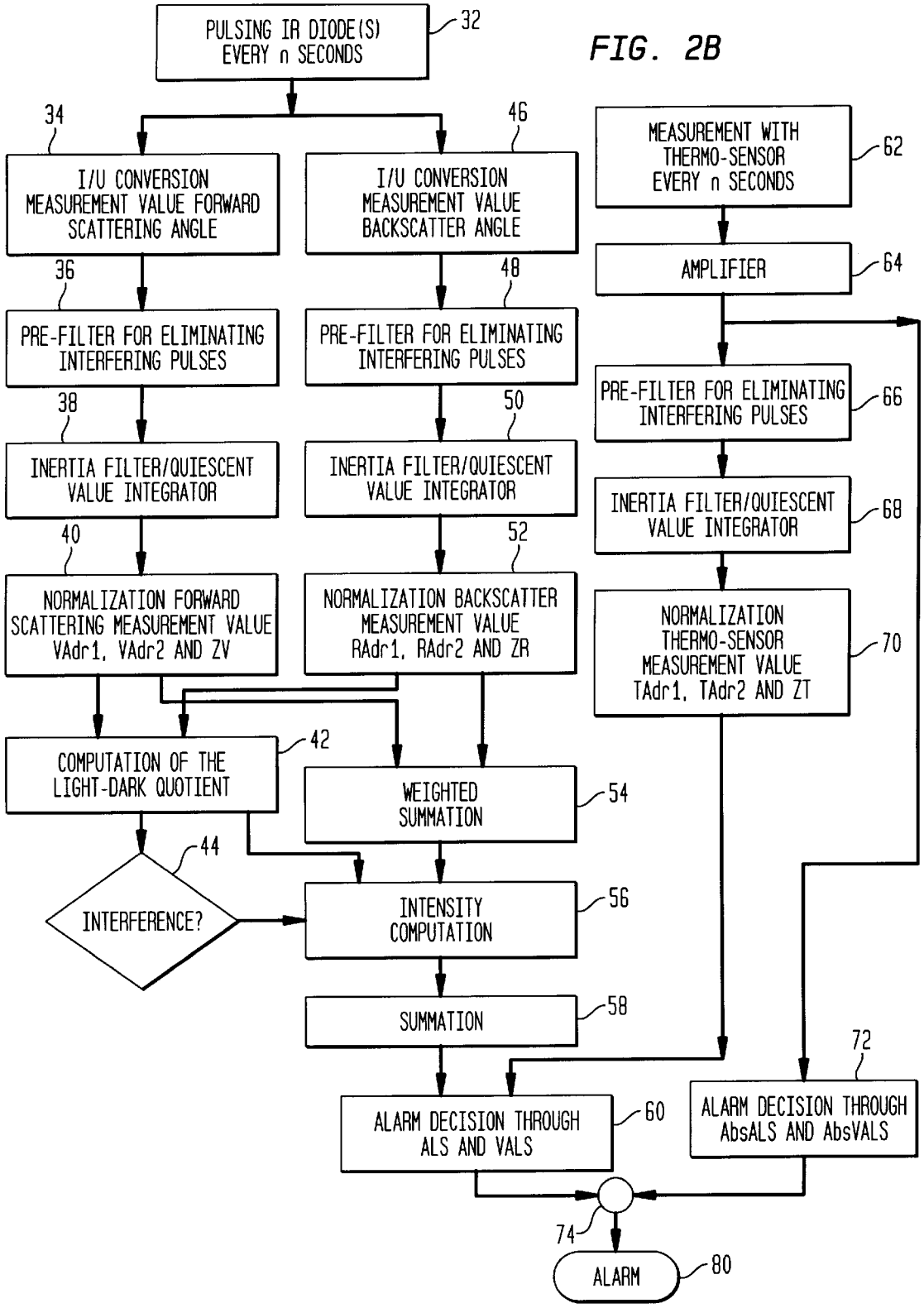
FIG. 2*b* shows a flow diagram of the method according to the invention.

A schematic circuit diagram of the fire detector of the invention is illustrated in FIG. 2*a*. FIG. 2*b* shows a corresponding flow diagram. In operation, the IR diodes are pulsed every n seconds by transmitter 1 which is triggered by clock circuit 10, step 32. If an aerosol is present in the measurement volume 24, then the IR radiation emitted by the transmitter 20 is scattered and directed to a receiver 22 associated with a forward scattering path and a receiver 21 associated with a backscatter path. The forward scattering angle is approximately 140° and the backscatter angle approximately 70°. Respective current/voltage converters 2 and 7 convert the measured photocurrent of the receivers 21 and 22 into a voltage, steps 34 and 46, respectively, which is then pre-filtered to eliminate voltage peaks, steps 36 and 48. To compensate for ambient light, integrators 3 and 8 integrate the quiescent signal value measured by the receiver 21, step 50, and the receiver 22, step 38, outside the transmission intervals of the transmission diode 20. This is made necessary by the fact that the chamber contains a small residual light component which is produced by residual reflections in the chamber, so that the quiescent signal is not equal to zero.

The scattered light fire detector may also include a temperature sensor 25, which may be a NTC sensor, such as a thermistor. The module 25, like the IR transmitter 20 and the receivers 21, 22, is controlled by the clock pulses, step 62, to keep the energy consumption of the fire detector as low as possible. The output of the temperature sensor 25 is amplified by amplifier 4, step 64, and can be pre-filtered to eliminate voltage peaks, step 66. A quiescent value integrator 9 determines a moving quiescent value, step 68. The time constant of the quiescent value integrator 9 is smaller than the time constant of the integrators 3 and 8 of the receivers 21, 22 for the following reason: the quiescent values of the scattered light paths are extremely constant and may change only slowly due to accumulation of dirt or aging. Moreover, since low-temperature fires may burn for several hours, the integrators should not compensate for the increase in the measured values. The time constant of the quiescent value integrators 3 and 8 should therefore be in the range of several hours. The ambient temperature, on the other hand, may change within minutes even in the absence of the fire, for example, when a window is opened. In the event of a fire, however, the temperature typically increases very rapidly. Accordingly, the time constant of the integrator 9 has to be set so that only very rapid temperature increases are taken into consideration for the evaluation.

However, certain types of fires may produce a very slow temperature increase. Such fires, however, tend to be accompanied by a lot of smoke which can be measured with the scattered light receivers 21, 22.

The measurement values are normalized following the integrators 8, 3, 9 and can be processed in a uniform manner by normalizing circuits 11, 12, 13 to yield normalized values $Z_V$, $Z_R$, $Z_T$, steps 40, 52 and 70, respectively. The light-dark-quotient $F_{L,D}$ of the aerosol which is present in the measurement volume of the fire detector, is computed from the two normalized scattered light measurement values $Z_V$, $Z_R$ by circuit 14, step 42. The quotient $F_{L,D}$ assigns a greater weight to the measurement signal of a dark aerosol than to the measurement signal of a light aerosol. The two weighted measurement signals $Z_V$, $Z_R$ are added in adder 17, step 54, and the weighted sum is multiplied with the light-dark-quotient $F_{L,D}$ in multiplier 16, step 56, taking into account any interfering signals, step 44. An additional weighted sum is computed in adder 18 from the output value of multiplier 16 and the normalized value $Z_T$, step 58, which takes into account the characteristic features of the temperature increase, as described above.

To reduce the effects of quantization noise, the light-dark quotient is calculated only when the forward scattering signal and the backward scattering signal exceed a minimal value stored in the EEPROM 15.

The output value of adder 18 is compared with a fixed alarm threshold stored in the EEPROM 28, step 60, and an alarm is triggered when this alarm threshold is exceeded, step 80.

The temperature may also increase very rapidly even in the absence of combustion aerosols. This may occur, for example, in the event of a pure alcohol fire. To reliably trigger an alarm even in this situation, a fixed temperature alarm threshold is stored in the EEPROM 28 of the fire detector, with an alarm being triggered when the fixed temperature alarm threshold is exceeded, step 72. Accordingly, an alarm is triggered by OR circuit 26, step 80, if either a maximum temperature or a maximum scattered light value has been exceeded.

Data which are important at the time of the alarm, may subsequently be analyzed further by copying the data from the working memory of the fire detector to another volatile memory (not shown).

Figure 3A:
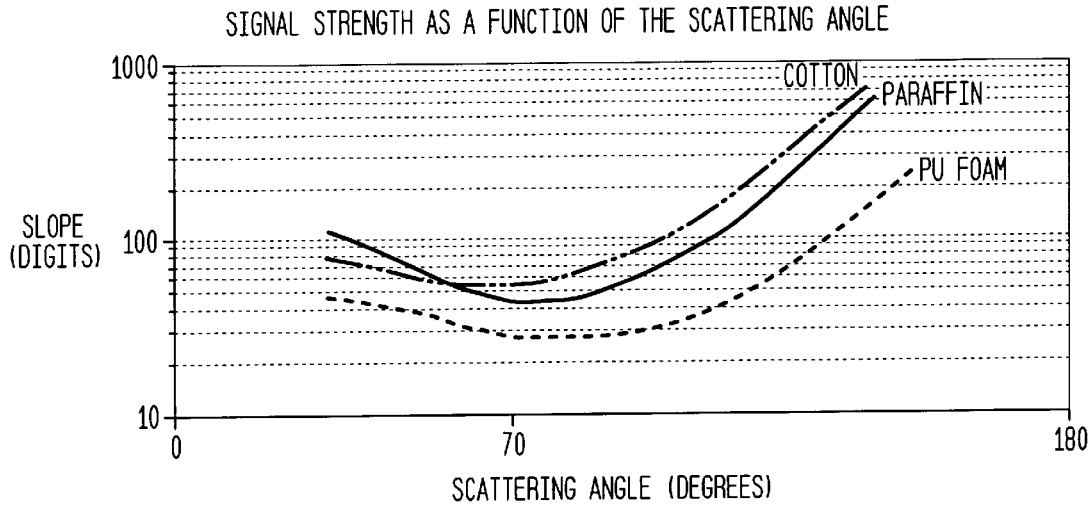
FIGS. 3*a* and 3*b* show the scattering signal as a function of the scattering angle for selected combustible materials.

FIG. 3*a* shows scattering signals of selected combustible materials as a function of the scattering angle. The characteristic curve is similar for all types of smoke. The signal increases towards both large and small scattering angles. Cotton and paraffin produce a light type of smoke. Burning polyurethane (PU) foam produces a dark aerosol. At a large scattering angle, a cotton aerosol produces a six times stronger scattering signal than a PU foam aerosol. The signal is only twice as large at the minimum located at approximately 70°.

Figure 3B:
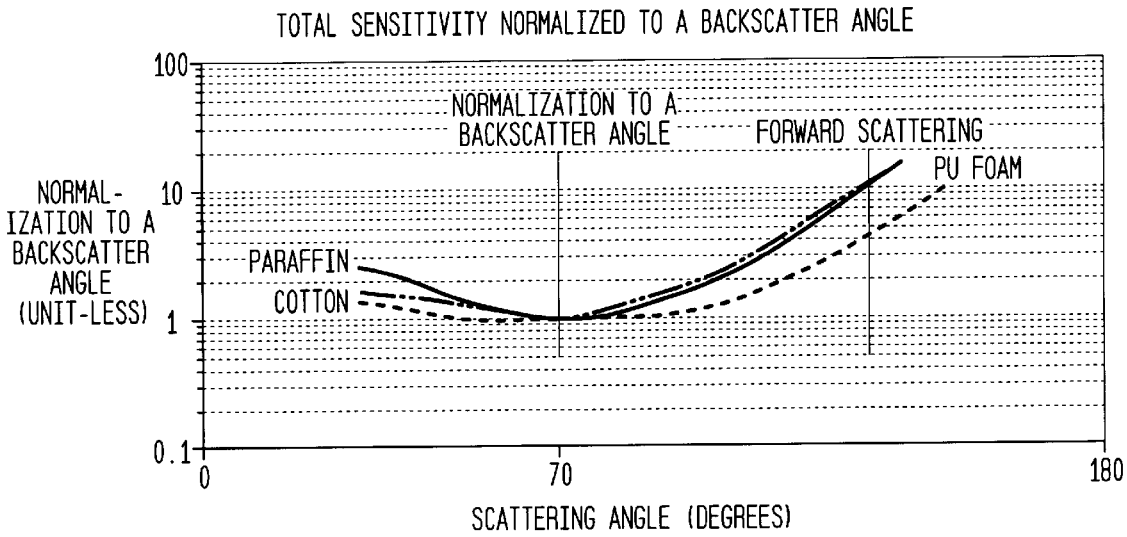

FIG. 3*b* shows signals corresponding to the signals illustrated in FIG. 3*a* and normalized to a backscatter angle of 70°. The fires of the listed combustible materials therefore produce aerosols which produce different light-dark quotients when normalized to the backscatter angle, which can be processed according the method of the invention.

While the invention has been illustrated and described as embodied in a scattered light fire detector, it is not intended to be limited to the details shown since various modifications and structural changes may be made without departing in any way from the spirit of the present invention.

What is claimed as new and desired to be protected by Letters Patent is set forth in the appended claims:

What is claimed is:

1. Method for evaluating scattering signals of a fire detector, comprising:

measuring the scattering signals at two scattering angles;

determining an alarm threshold; and comparing an alarm value with the alarm threshold, wherein the alarm value is determined as a function of the ratio of the scattering signals, the ratio of the scattering signals defining a factor F, F' with $$F=((S_R/S_V)-0.2)/0.6$$

for $(S_R/S_V)$ between 0.2 and 0.8, and $$F'=2-((S_R/S_V)-0.2)/0.2$$

for $(S_R/S_V)$ greater than 0.8, wherein the factor F, F' defines a brightness of an aerosol, with $S_R$ corresponding to a backscatter signal and $S_V$ corresponding to a forward scattering signal.

2. The method according to claim 1, wherein a first of the two scattering angles is a backscatter angle having a value of approximately 70°.

3. The method according to claim 2, wherein the second of the two scattering angles is a forward scattering angle having a value of approximately two times that of the backscatter angle.

4. The method according to claim 1, wherein the ratio of the scattering signals of at least one fraudulent value is stored in a memory.

5. A method for evaluating scattering signals of a fire detector, comprising:

measuring the scattering signals at two scattering angles;

determining an alarm threshold; and comparing an alarm value with the alarm threshold, wherein the alarm value is determined as a function of the ratio of the scattering signals and is a weighted sum of values corresponding to the scattering signals.

6. The method according to claim 5, wherein a first of the two scattering angles is a backscatter angle having a value of approximately 70°.

7. The method according to claim 5, wherein the second of the two scattering angles is a forward scattering angle having a value of approximately two times that of the backscatter angle.

8. The method according to claim 5, wherein the ratio of the scattering signals of at least one fraudulent value is stored in a memory.

9. The method according to claim 5, wherein the scattering signals are determined simultaneously.

10. The method according to claim 5, wherein the scattering signals are determined alternatingly.

11. The method according to claim 5, wherein the scattering signals are filtered before being processed.

12. A method for evaluating scattering signals of a fire detector, comprising:

measuring the scattering signals at two scattering angles;

determining an alarm threshold; and comparing an alarm value with the alarm threshold, wherein the alarm value is determined as a function of the ratio of the scattering signals and the scattering signals are multiplied with at least one value corresponding to an additional input value.

13. The method according to claim 12, wherein the additional input value is an ambient temperature.

14. The method according to claim 12, wherein a first of the two scattering angles is a backscatter angle having a value of approximately 70°.

15. The method according to claim 12, wherein the second of the two scattering angles is a forward scattering angle having a value of approximately two times that of the backscatter angle.

16. The method according to claim 12, wherein the ratio of the scattering signals of at least one fraudulent value is stored in a memory.

17. The method according to claim 12, wherein the scattering signals are determined simultaneously.

18. The method according to claim 12, wherein the scattering signals are determined alternatingly.

19. The method according to claim 12, wherein the scattering signals are filtered before being processed.

20. A method for evaluating scattering signals of a fire detector, comprising:

measuring the scattering signals at two scattering angles;

determining an alarm threshold; and comparing an alarm value with the alarm threshold, wherein the alarm value is determined as a function of the ratio of the scattering signals, and wherein for each scattering angle a quiescent value is determined and the quiescent value is subtracted from the corresponding scattering signal.

21. The method according to claim 20, wherein a first of the two scattering angles is a backscatter angle having a value of approximately 70°.

22. The method according to claim 20, wherein the second of the two scattering angles is a forward scattering angle having a value of approximately two times that of the backscatter angle.

23. The method according to claim 20, wherein the ratio of the scattering signals of at least one fraudulent value is stored in a memory.

24. The method according to claim 20, wherein the scattering signals are determined simultaneously.

25. The method according to claim 20, wherein the scattering signals are determined alternatingly.

26. The method according to claim 20, wherein the scattering signals are filtered before being processed.

27. The method according to claim 1, wherein the scattering signals are determined simultaneously.

28. The method according to claim 1, wherein the scattering signals are determined alternatingly.

29. The method according to claim 1, wherein the scattering signals are filtered before being processed.

30. A scattered light fire detector, comprising:

a scattered light system for determining scattering signals having at least a forward scattering angle and a backscatter angle;

a processor which determines an alarm value from a ratio of the scattering signals and compares the alarm value with a predetermined alarm threshold; and a temperature sensor which measures an ambient temperature, wherein the scattering signals are multiplied with at least one value corresponding to the ambient temperature.

31. The scattered light fire detector according to claim 30, wherein the scattered light system comprises one transmitter diode and two receiver diodes.

32. The scattered light fire detector according to claim 30, wherein the scattered light system comprises two transmitter diodes and one receiver diode.

33. The scattered light fire detector according to claim 30, and further comprising an EEPROM.

34. The scattered light fire detector according to claim 30, and further comprising an interface for connecting to a computer.

35. The scattered light fire detector according to claim 30, wherein the processor is a microprocessor.

* * * * *